United States Patent [19]

McManus et al.

[11] 4,429,737

[45] Feb. 7, 1984

[54] WRAPPED FIN HEAT EXCHANGER

[75] Inventors: John R. McManus, Marcellus; Dale Jackson, Clay, both of N.Y.

[73] Assignee: Carrier Corporation, Syracuse, N.Y.

[21] Appl. No.: 320,380

[22] Filed: Nov. 12, 1981

[51] Int. Cl.[3] ..... F24B 1/06

[52] U.S. Cl. ..... 165/125; 165/172; 165/147; 62/508

[58] Field of Search ..... 165/125, 172, 140, 147, 165/164; 62/507, 508

[56] References Cited

U.S. PATENT DOCUMENTS

| | | | |
|---|---|---|---|
| 1,791,528 | 2/1931 | Hull | 165/147 |
| 1,915,352 | 6/1933 | Bottoms | 165/172 |
| 1,965,553 | 7/1934 | Lear | 165/140 |
| 3,134,166 | 5/1964 | Venables . | |
| 3,139,932 | 2/1981 | Hanert et al. . | |
| 4,048,834 | 9/1977 | Durbin et al. . | |
| 4,077,116 | 3/1978 | Cunningham et al. . | |
| 4,085,488 | 4/1978 | Hanert et al. . | |
| 4,224,984 | 9/1980 | Miyata et al. . | |

*Primary Examiner*—William R. Cline
*Assistant Examiner*—John F. McNally
*Attorney, Agent, or Firm*—Donald F. Daley; Robert P. Hayter

[57] ABSTRACT

A wrapped fin heat exchanger formed from a continuous length of tubing having a fin wrapped thereabout to provide an enhanced heat transfer surface is disclosed. A cylindrical core portion is formed from loops of tubing and a second cylindrical locking portion is mounted thereabout. The locking portion has bands which extend about and in engagement with the loops of the core portion to secure the heat exchanger in a predetermined configuration. By utilization of the locking portion and the core portion the unwinding of the heat exchanger is prevented and its structural integrity is maintained for subsequent manufacturing operations.

7 Claims, 3 Drawing Figures

WRAPPED FIN HEAT EXCHANGER

BACKGROUND OF THE INVENTION

1. Field of the Invention

This invention relates to heat exchangers for transferring heat energy between two separate fluids. More particularly the present invention relates to a wrapped fin heat exchanger having a fin material wrapped about a tube to form an enhanced heat transfer surface. As set forth herein a continuous length of fin tubing is wrapped into a generally cylindrical configuration and has portions thereof wrapped about other portions to maintain the tubing in the selected configuration.

2. Description of the Prior Art

It is known to manufacture a heat transfer surface formed by having a base tubular member fabricated from aluminum or another heat transfer material and having a fin material helically wound about the base member. This fin material may be formed in a U-shape and wrapped about the tube with the base of the fin contacting the exterior surface of the base tube to form a metal to metal contact promoting heat transfer from the tube to the fin. By this extended fin surface it is possible to provide increased heat transfer between the fluid flowing through the tube and a gaseous substance flowing over the tube. A fin surface of the type described is disclosed in U.S. Pat. No. 3,134,166 issued to Venables.

This wrapped fin tubing is specifically formed into a geometrical configuration in conjunction with a heat exchange unit and a fan for circulating air thereover. A heat exchanger of this material has many applications. A typical application would be in a refrigeration circuit for an air conditioning system wherein refrigerant flows through the tube and air flows over the exterior enhanced portion of the heat exchanger. In these applications heat energy is transferred between the air flowing over the exterior and in contact with the wrapped fins and the refrigerant flowing through the interior of the tube. A heat exchanger may be formed in many configurations to provide the appropriate air flow relationship thereover. A fan is typically mounted as part of an air conditioning unit for drawing air through or pushing air over the heat transfer surface. The heat exchanger typically is configured to promote air flow as directed by the fan over the heat exchange surface.

One of the many configurations possible for a heat exchange unit of this type is a cylinder. When a long continuous tube is wrapped into a generally cylindrical configuration there is little inherent support within the structure. The tube may be wound about a drum in a helical manner to form the primary heat exchange surface. Upon removing the tubing from the drum there is a tendency of the tubing to unwind and collapse. The handling of the heat exchanger in this configuration becomes particularly difficult since the degree of unwinding or other change from the form wrapped about the drum is unpredictable and the person doing such handling must accommodate such changes.

One way to prevent the heat exchanger from changing dimension when removed from the drum is to provide a structural support mechanism which secures the individual loops of tubing into the desired configuration. This structural arrangement may be mounted to the heat exchanger before removal from the drum.

Another manner in which the structural integrity of the heat exchanger may be maintained is as disclosed herein by the use of a locking portion formed by wrapping tubing in a reverse helical direction over the core portion of the heat exchanger such that the bands wound in the reverse direction interlock with the loops wound in the first direction to maintain the structural integrity of the heat exchanger.

SUMMARY OF THE INVENTION

It is an object of the present invention to provide a heat exchanger which may be formed from wrapped fin tubing.

Another object of the present invention is to provide a wrapped fin tubing heat exchanger which incorporates structural integrity from the tubing geometry.

A further object is to provide a locking portion of tubing to secure a core portion of a wrapped fin heat exchanger in position.

A further object of the present invention is to provide a heat exchanger wherein the tubing itself prevents the heat exchanger from unwinding or collapsing.

Further objects of the present invention will be apparent from the description to follow and from the preferred embodiment thereof.

These and other objects are achieved in accordance with the preferred embodiment of the present invention by the use of a wrapped fin heat exchanger made from a single length of wrapped fin tubing having a tubular fluid conducting portion and fin material wrapped about the tubular portion to promote heat transfer between fluid flowing through the tubular portion and gas flowing thereover. A core portion of tubing is formed in a generally cylindrical configuration having a plurality of helically inclined loops of wrapped fin tubing, each loop being located a predetermined distance from the adjacent loop. A locking portion of tubing is formed in a generally cylindrical configuration having a diameter different from the diameter of the core portion and having at least one helical band extending between opposite ends of the heat exchanger to secure the loops of the core portion in the cylindrical configuration as formed. The locking portion may include multiple bands, said bands having a larger spacing between adjacent bands than the spacing between adjacent loops. The projecting fins from the bands act to engage the projecting fins from the loops such that the intermesh between the fins provides for structural integrity of the unit.

DESCRIPTION OF THE PREFERRED EMBODIMENT

The preferred embodiment of the present invention is shown herein having a wrapped fin heat exchanger with a core portion and a locking portion formed thereabout. The present invention discloses utilizing various spacing relationships in the specific embodiment. It is to be understood by those versed in the art that modifications and variations can be made in spacing, the relative location of the loops versus the bands and the remaining design elements of the heat exchanger. The term cylindrical heat exchanger as used herein refers to heat exchangers having square or rectangular or similar shapes as well as those being circular in cross section.

Figure 1:
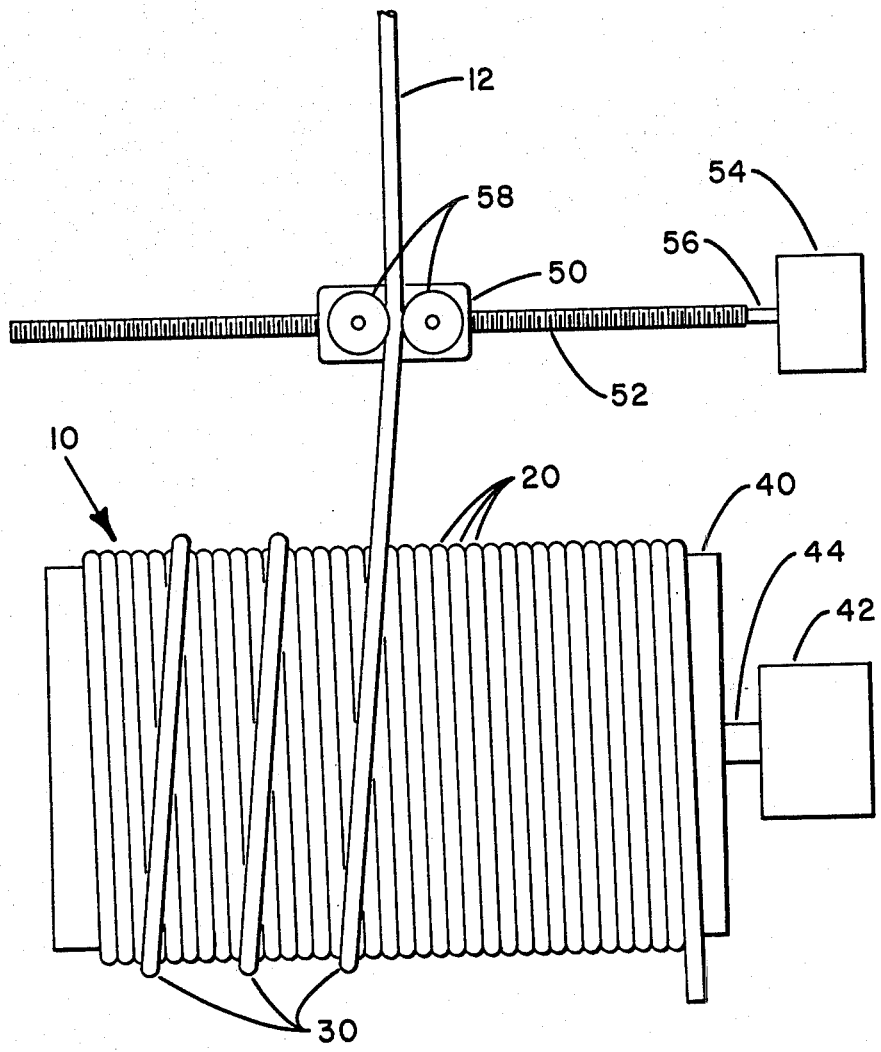
FIG. 1 is a schematic view of a wrapped fin heat exchanger being wound about a drum.

Referring first to FIG. 1 it may be seen that heat exchanger 10 is formed by wrapping tube 12 about drum 40. Drum 40 is shown as a large cylindrical drum driven by motor 42 through shaft 44. The motor acts to rotate the drum in a single direction as head 50 guides tubing 12 as it is wrapped about the drum. As can be seen on drum 40, the tubing is divided into individual loops 20 which are closely spaced and wrapped in a first helical direction about the drum and bands 30 wrapped over loops 20 and spaced from the loops of tubing.

Head 50 including guide wheels 58 is shown for aligning tubing 12 with drum 40. Motor 54 through shaft 56 rotates threaded rod 52 in either direction. By energizing motor 54 head 50 and consequently tubing 12 are moved longitudinally relative to drum 40 such that the location of the tubing being wrapped about the drum and the helical angle formed as the head moves relative to the drum are both controlled by the rate and direction of rotation of threaded rod 52. As can be seen from FIG. 1, in order to obtain the difference in helical angles between loops 20 and bands 30 motor 54 is operated at varying speeds and in opposite directions. Since the drum is rotated at a constant velocity the relative speed and direction of motor 54 acts to control both the helical angle of the wrapped fin tubing about the drum and the spacing between adjacent wraps.

Figure 3:
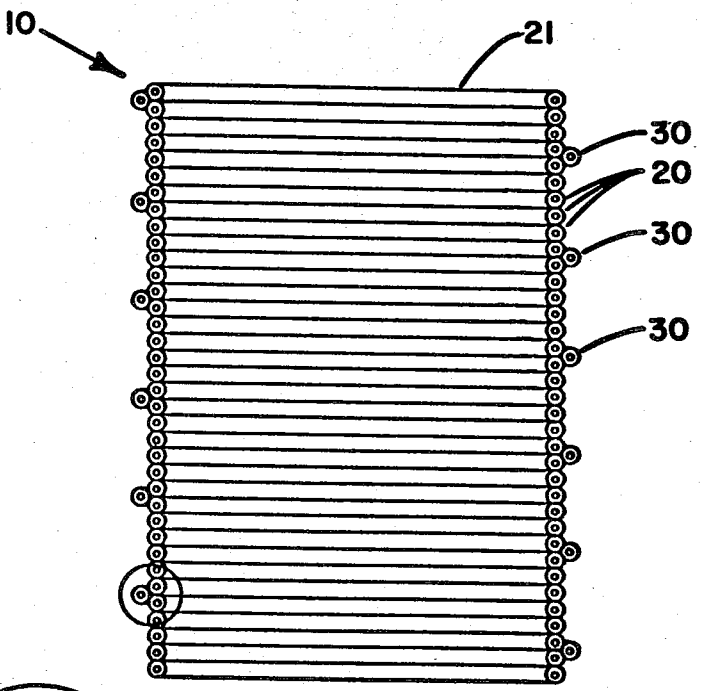
FIG. 3 is a cross-sectional view of the heat exchanger of FIG. 2 including a small enlarged portion showing the intermesh between fins of the tubing.
Figure 3A:
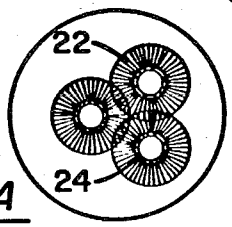
Figure 2:
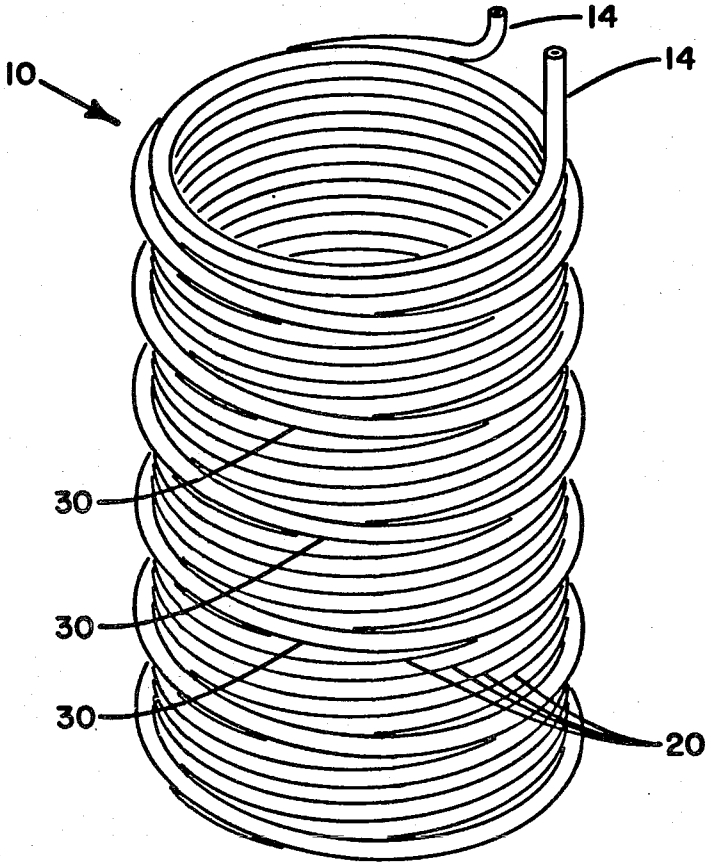
FIG. 2 is an isometric view of a heat exchanger.

FIGS. 2 and 3 are views of heat exchanger 10 after its removal from the drum. As can be seen therein, a center core portion 21 is formed by loops 20 located in a generally cylindrical configuration. A second locking portion 31 is formed by bands 30 being in contact with the exterior of loops 20 forming core portion 21. It can be seen that the loops are located in a helical configuration being spaced just sufficiently apart that the ends of the fins 22 projecting from the individual tubes 24 just engage the ends of the fins 22 of the adjacent loop. The spacing is continuous for the length of the heat exchanger such that any air being drawn through the heat exchange surface must pass in close relationship with an extending fin. Typically, air is drawn through the tubing into the center of the cylindrical heat exchanger by locating a fan to exhaust air from the center of the heat exchanger.

It is further seen in FIGS. 2 and 3 that the fins extending from the locking portion formed from loops 30 likewise engage the fins extending from the loops of core portion 21. By having the locking portion extend at a helical angle in the opposite direction from the core portion and by having the spacing between adjacent bands of the locking portion significantly greater than the spacing between adjacent loops of core portion, the bands tend to overlap the loops and the fins engage the bands to the loops to secure the entire heat exchanger in a predetermined position.

As can be seen in all these figures the loops are wound in a first helical direction, i.e. motor 54 drives the threaded rod in a clockwise or counterclockwise direction displacing the head guiding tubing 12 the length of the heat exchanger. Once the total length of the heat exchanger is wrapped with loops 20 to form the core portion motor 54 is reversed and operated at a speed which may be typically six times faster than the speed while operating in the first direction. The bands are wound about the loops with a helical angle and a spacing between bands, which is six times greater than the spacing between the loops and which angle is six times the helical angle between loops. Hence, by the head traveling in one direction and then returning the loops are first wound about the drum and in the return direction the bands are wound about the drum. Therefore, it may be seen that a single piece of tubing is utilized to form a continuous circuit extending the length of the heat exchanger twice. Header connecting portions 14 may be formed at one end of the heat exchanger such that if a single circuit for the heat exchanger is desired then the connections may be made adjacent each other. Of course it is also possible to cut the tubing between the ends to form multiple circuits by making other header arrangements.

It can be seen herein that the diameter of the cylinder formed by the locking portion is greater than the diameter of the cylinder formed by the core portion. It may additionally be seen that the ratio spacing between the adjacent bands of the locking portions and adjacent loops of the core portion is six. Although this spacing ratio of six times has been determined to be effective it is believed that any spacing ratio of 3 or more would serve suitably to accomplish this function. It has additionally been found that with the addition of a locking portion the core portion may be made with less heat transfer surface since there is heat transfer between fluid flowing through the tube and air flowing thereover in the locking portion as well as the core portion. It is also apparent that the locking portion could be wrapped first about the drum and the core portion wrapped thereover to achieve essentially the same purpose.

The invention has been described with reference to a particular embodiment, however, it will be understood by those skilled in the art that various changes may be made and equivalents may be substituted for elements thereof without departing from the scope of the invention. In addition many modifications may be made to adopt a particular situation or material to the teaching of the invention without departing from the essential scope thereof. Therefore, it is intended that the invention not be limited to the particular embodiment disclosed as the best mode contemplated for carrying out the invention but that the invention will include all embodiments falling within the scope of the appended claims.

What is claimed is:

1. A wrapped fin heat exchanger made from a single length of wrapped fin tubing including a tubular fluid conducting portion and fin material wrapped about the tubular portion to promote heat transfer to a gas flowing thereover which comprises:

a core portion of tubing formed in a generally cylindrical configuration having a plurality of helical loops of wrapped fin tubing, each loop being located a predetermined distance from the adjacent loop; and a locking portion of tubing formed in a generally cylindrical configuration having a diameter different from the diameter of the core portion and having at least one helical band extending between opposite ends of the heat exchanger to secure the loops of the core portion in the cylindrical configuration as formed.

2. The apparatus as set forth in claim 1 wherein the helical loops of the core portion are inclined in a first direction and the helical bands of the locking portion are inclined in a second opposite direction.

3. The apparatus as set forth in claim 1 wherein the loops of tubing forming the core portion are spaced sufficiently close to each other to prevent air from flowing therebetween without transferring heat energy between the air and the wrapped fins and are spaced sufficiently far apart that air may flow between adjacent loops and wherein the spacing between adjacent bands of the locking portion is at least three times greater than the spacing between adjacent loops of the core portion.

4. The apparatus as set forth in claim 3 wherein the spacing between adjacent bands of the locking portion is six times greater than the spacing between adjacent loops of the core portion.

5. The apparatus as set forth in claim 1 wherein fins of the wrapped fin tubing extend from the loops of the core portion and engage the fins extending from the bands of the locking portion to secure the core portion in position.

6. The apparatus as set forth in claim 1 wherein the locking portion and the core portion of the heat exchanger are connected as part of a fluid flow path through the heat exchanger.

7. The apparatus as set forth in claim 1 wherein at least one end of both the locking portion and the core portion are located adjacent each other for making the appropriate header connections to conduct a fluid into and out of the heat exchanger.

* * * * *